US008358323B2

(12) United States Patent
Bray et al.

(10) Patent No.: US 8,358,323 B2
(45) Date of Patent: Jan. 22, 2013

(54) WRITE HEATING ARCHITECTURE FOR DUAL MODE IMAGING SYSTEMS

(75) Inventors: Daniel Martin Bray, Rochester, NY (US); Anthony S. Condello, Webster, NY (US); Grace T. Brewington, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 389 days.

(21) Appl. No.: 12/542,481

(22) Filed: Aug. 17, 2009

(65) Prior Publication Data

US 2011/0037803 A1 Feb. 17, 2011

(51) Int. Cl.
*B41J 29/36* (2006.01)

(52) U.S. Cl. ..... 347/171; 347/104; 400/582

(58) Field of Classification Search ..... 347/101–104, 347/171, 2, 3; 400/582
See application file for complete search history.

(56) References Cited

U.S. PATENT DOCUMENTS 5,557,312 A * 9/1996 Sago ..... 347/171
6,161,973 A * 12/2000 Kawamura et al. ..... 400/582
2007/0072110 A1 3/2007 Iftime et al.
2008/0311495 A1 12/2008 Norsten et al.
2010/0225722 A1* 9/2010 Elrod et al. ..... 347/104

FOREIGN PATENT DOCUMENTS

EP 2228221 9/2010
JP 2003015475 1/2003

OTHER PUBLICATIONS

European Patent Office, European Search Report, European Application No. 10172507.5, Oct. 26, 2010, 7 Pages.

* cited by examiner

*Primary Examiner* — Lam S Nguyen
(74) *Attorney, Agent, or Firm* — MH2 Technology Law Group LLP

(57) ABSTRACT

A dual mode imaging system includes an ink jet device for imaging non-erasable media and a write device for imaging erasable media. A media transport subsystem is provided for supplying non-erasable and erasable media to one of the ink jet device and the write device. A heat source is incorporated into the media transport subsystem, and particularly in connection with a guide baffle of the ink jet device, the heat source heating erasable media to a temperature suitable for imaging at the write device.

28 Claims, 5 Drawing Sheets

WRITE HEATING ARCHITECTURE FOR DUAL MODE IMAGING SYSTEMS

FIELD OF THE INVENTION

This invention relates generally to imaging and, more particularly, to imaging both reversible write erasable media and non-erasable paper in an imaging system.

BACKGROUND OF THE INVENTION

Paper documents are often promptly discarded after being read. Although paper is relatively inexpensive, the quantity of discarded paper documents is enormous and the disposal of these discarded paper documents raises significant cost and environmental issues. It would, therefore, be desirable for paper documents to be reusable, to minimize both cost and environmental issues.

Erasable media is that which can be reused many times to transiently store images, the images being written on and erasable from the erasable media. For example, photochromic paper employs photochromic materials to provide an imageable surface. Typically, photochromic materials can undergo reversible or irreversible photoinduced color changes in the photochromic containing layer. In addition, the reversible photoinduced color changes enable imaging and erasure of photochromic paper in sequence on the same paper. For example, a light source of a certain wavelength can be used for imaging erasable media, while heat can be used for inducing erasure of imaged erasable media. An inkless erasable imaging formulation is the subject of U.S. patent application Ser. No. 12/206,136 filed Sep. 8, 2008 and titled "Inkless Reimageable Printing Paper and Method" which is commonly assigned with the present application to Xerox Corp., and is incorporated in its entirety herein by reference.

Because imaging of erasable media has unique requirements, it has previously required dedicated equipment. In particular, a UV source can be required to image the erasable media, and heat can be required to erase an imaged erasable media. In addition, specific temperature parameters are required for each of the imaging and erasing of erasable media. While traditional imaging devices are suitable for performing conventional imaging of non-erasable media, their architecture can be insufficient for handling erasable media alone or in combination with non-erasable media.

Thus, there is a need to overcome these and other problems of the prior art and to provide a dual mode imaging device in which both erasable media and non-erasable paper can be selectively imaged. Even further, the dual mode imaging device should be capable of interchangeably sharing imaging components.

SUMMARY OF THE INVENTION

According to various embodiments, the present teachings include a dual mode imaging system. This system includes an ink jet device for imaging non-erasable media; a write device for imaging erasable media; a media transport subsystem for supplying non-erasable and erasable media to one of the ink jet device and the write device; and a heat source incorporated into the media transport subsystem, the heat source heating erasable media to a temperature suitable for imaging at the write device.

According to various embodiments, the present teachings include a dual mode imaging device. The device includes an ink jet device for imaging non-erasable media; a write device for imaging erasable media; and a heat source incorporated into a paper advance guide baffle of the ink jet device, an imaging temperature of an erasable medium established by the heat source.

According to various embodiments, the present teachings also include a method of dual mode imaging. This method includes incorporating a heat source with a paper advance guide baffle of an ink jet imaging device, the guide baffle forming a common media path for each of erasable media and non-erasable media; establishing, via the heat source, an imaging temperature of an erasable medium; selectively imaging erasable media at the imaging temperature with a write device; selectively imaging non-erasable media with the ink jet device; and cooling an imaged erasable medium.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

It should be noted that some details of the figures have been simplified and are drawn to facilitate understanding of the inventive embodiments rather than to maintain strict structural accuracy, detail, and scale.

DESCRIPTION OF THE EMBODIMENTS

Reference will now be made in detail to the present embodiments (exemplary embodiments) of the invention, examples of which are illustrated in the accompanying drawings. Wherever possible, the same reference numbers will be used throughout the drawings to refer to the same or like parts. In the following description, reference is made to the accompanying drawings that form a part thereof and in which is shown by way of illustration specific exemplary embodiments in which the invention may be practiced. These embodiments are described in sufficient detail to enable those skilled in the art to practice the invention and it is to be understood that other embodiments may be utilized and that changes may be made without departing from the scope of the invention. The following description is, therefore, merely exemplary.

As used herein, the term "erasable media" refers to transient material that has the appearance and feel of traditional paper, including cardstock and other weights of paper. Erasable media can be selectively imaged and erased.

As used herein, imaged erasable media refers to erasable media having a visible image thereon, the image a result of, for example, ultraviolet (UV) imaging of the erasable media.

As used herein, non-imaged erasable media refers to erasable media which has not been previously imaged, or erasable media having an image erased therefrom and available for UV imaging. An exemplary erasable medium is described in connection with FIG. 1 below.

As used herein, the term "non-erasable" refers to traditional media of the type used in any conventional imaging such as ink jet, xerography, or liquid ink electrophotography, as known in the art. An example of a non-erasable traditional medium can be conventional paper.

Figure 1:
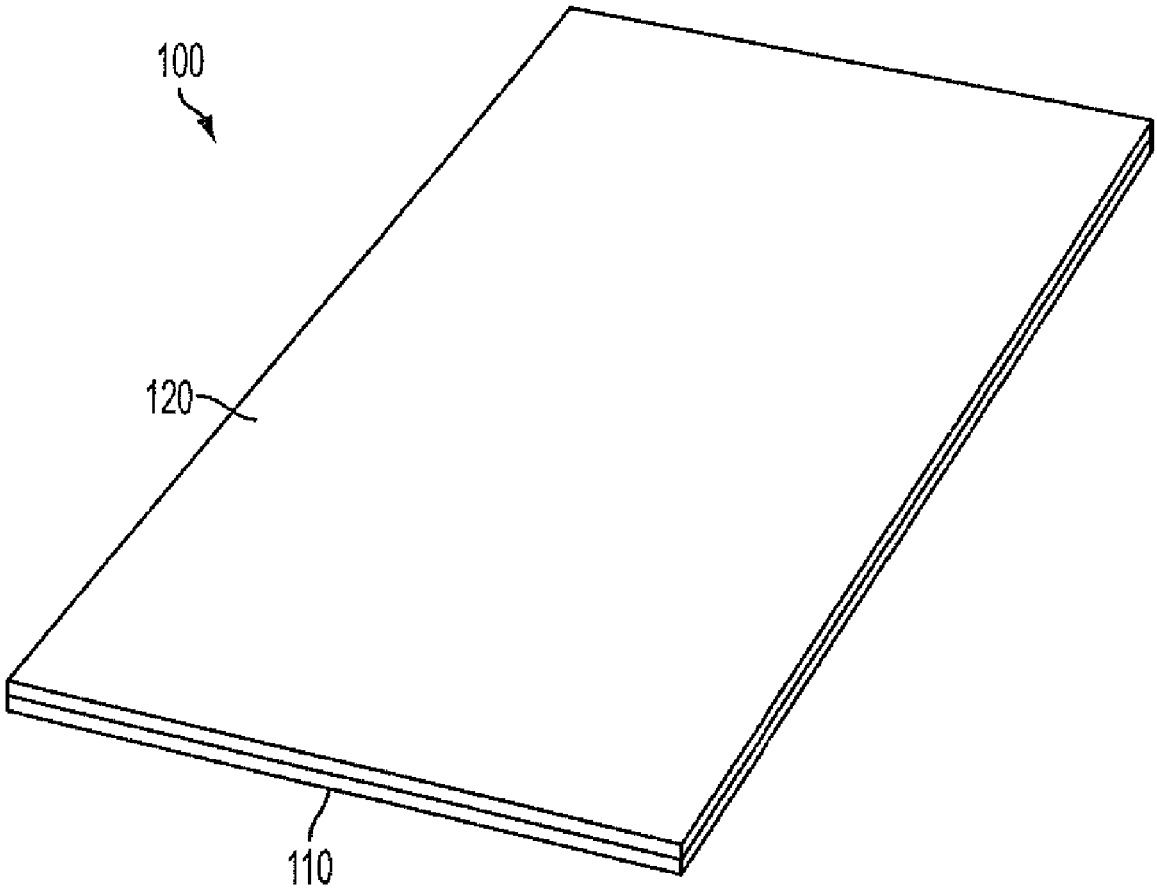
FIG. 1 is a perspective depiction of an erasable medium.

FIG. 1 depicts an exemplary erasable medium 100 in accordance with the present teachings. It should be readily apparent to one of ordinary skill in the art that the erasable medium 100 depicted in FIG. 1 represents a generalized schematic illustration and that other layers can be added or existing layers can be removed or modified.

As shown in FIG. 1, the erasable medium 100 can include a substrate 110 and a photochromic material 120 incorporated into or on the substrate 110. The photochromic material 120 can provide a reversible writing (i.e. erasable) image-forming component on the substrate 110.

The substrate 110 can include, for example, any suitable material such as paper, wood, plastics, fabrics, textile products, polymeric films, inorganic substrates such as metals, and the like. The paper can include, for example, plain papers such as XEROX® 4024 papers, ruled notebook paper, bond paper, and silica coated papers such as Sharp Company silica coated paper, Jujo paper, and the like. The substrate 110, such as a sheet of paper, can have a blank appearance.

In various embodiments, the substrate 110 can be made of a flexible material and can be transparent or opaque. The substrate 110 can be a single layer or multi-layer where each layer is the same or different material and can have a thickness, for example, ranging from about 0.05 mm to about 5 mm.

The photochromic material 120 can be impregnated, embedded or coated to the substrate 110, for example, a porous substrate such as paper. In various embodiments, the photochromic material 120 can be applied uniformly to the substrate 110 and/or fused or otherwise permanently affixed thereto.

Portion(s) of photochromic material of an imaged erasable medium 100 can be erased. In order to produce the transition from a visible image to an erased medium, heat can be applied to the erasable medium 100 at a temperature suitable for effecting the erasure. For example, at a temperature between about 80° C. to about 200° C., the erasable medium 100 can be completely erased. In certain embodiments, the erasable medium can be erased at ambient temperature and with light in the visible spectrum. In order to re-image the erased (or image an original) erasable medium 100, the erasable medium 100 can be heated to a temperature of between about 55° C. to about 80° C. before writing using, for example, UV exposure.

It will be appreciated that other types of erasable media, other than photochromic paper, can be used in connection with the exemplary embodiments herein. Such types of erasable media are intended to be included within the scope of the disclosure.

While the temperatures for processing erasable media can be achieved and maintained in a single mode device for imaging and erasing erasable media, the following describes an exemplary incorporation of a dual mode imaging system capable of processing erasable media as well as producing traditional (non-erasable) prints and copies. The traditional prints and copies can be produced by ink jet. The ink jet can include aqueous ink jet, solid ink jet and gel ink jet.

Figure 2:
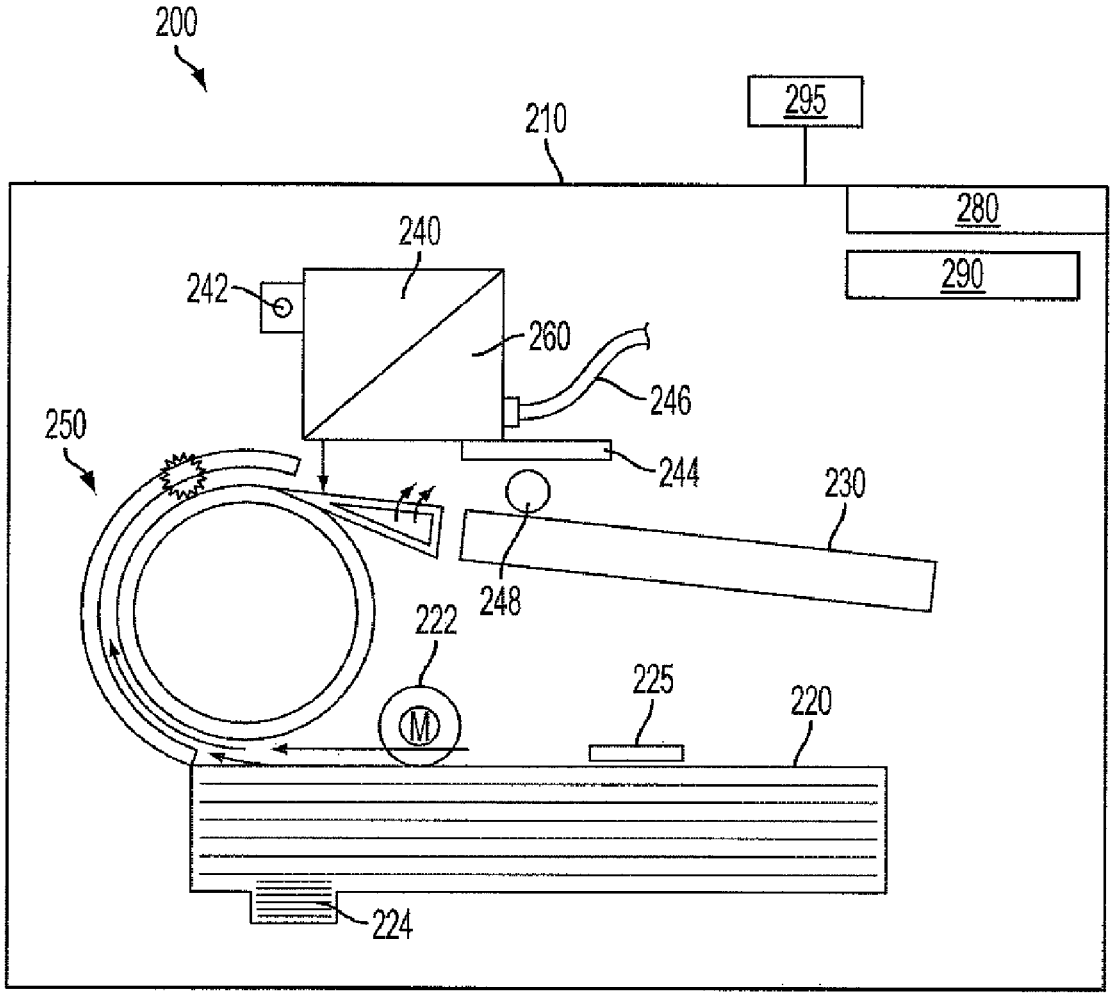
FIG. 2 is a perspective view depicting a dual mode imaging device in accordance with the present teachings.

FIG. 2 depicts an exemplary dual mode imaging system 200 incorporating each of an ink jet printer and an erasable media write system in accordance with the present teachings. It should be readily apparent to one of ordinary skill in the art that the dual mode imaging system 200 depicted in FIG. 2 represents a generalized schematic illustration and that other components can be added or existing components can be removed or modified.

As shown in FIG. 2, the dual mode imaging system 200 can include housing 210 with media input 220 and output 230 locations. In addition, the dual mode imaging system 200 can include a conventional imaging subsystem 240, an erasable media write subsystem 260, a temperature management subsystem 250, a user interface 280, a control system 290, and an administrator interface 295.

The housing 210 can be of a material and size to accommodate the exemplary components of the dual mode imaging system 200. In certain embodiments, the housing 210 can include a desktop device. The housing 210 can further include a full size floor supported device. Sizes for each are known in the art and not intended to limit the scope of the invention.

The media inputs 220 can include one or more input trays for each of an erasable media and non-erasable media. As used herein, if an erasable media is in the original state, i.e. not previously imaged, it can also be referred to as an "erased" erasable media for ease of description. For the erasable media, separate input trays can be provided for each of erased and imaged erasable media in order to distinguish an operation within the dual mode imaging system 200 relevant to each. Other combinations of media are intended to be within the scope of the disclosure. Although the input trays are initially labeled by example and purposes of discussion according to the type of media therein; their relative arrangement both interior and exterior to the housing 210 can be altered according to a configuration of components within the housing 210.

In embodiments, a sensor 225 can be provided to detect a type of media entering the dual mode imaging device 200. The sensor 225 can be proximate each input tray 220, incorporated in the input tray 220, or interior of the housing 210. For example, the sensor 225 can detect an erasable media 100 and control system 290 can select activation or use of one of a conventional imaging subsystem 240 or the erasable media write subsystem 260.

The selected medium can be moved along an imaging path in the direction noted by the arrows. Single sheets of the selected medium are fed from input 220 by document feed roll 222 driven by a motor M under the control of a printer controller (not shown). The input 220 can be spring biased by biasing mechanism 224 which forces the top sheet of a stack of media into contact with the feed roller 222. A top most medium, in contact with the feed roller 222, is transported into the temperature management subsystem 250, details of which are described further in connection with FIGS. 3A and 3B.

The conventional imaging subsystem 240 can include components suitable for imaging a non-erasable media. In certain embodiments, the imaging subsystem 240 can include an ink jet imaging system. The conventional ink jet imaging subsystem 240 can include a translating ink jet printhead depositing black and/or colored ink drops through a plurality of nozzles is supported by a housing which moves back and fourth across the non-erasable medium, on a guide rail 242 and a supporting shelf 244 as known in the art. Multiple print heads printing different colors are within the scope of this invention as well as a single printhead being segmented for printing different colors. The ink jet subsystem 240 can include any of solid ink jet, gel ink jet and aqueous ink jet whose structure and function are known in the art.

In certain embodiments, the write subsystem 260 can include imaging components suitable for imaging erasable media. For example, the write subsystem 260 can UV image an erasable media. In embodiments, UV imaging can be implemented once the erasable media reaches a predetermined temperature. An exemplary UV imaging temperature of an erasable media can be from about 50° C. to about 80° C. A UV imaging temperature can further be from about 60° C. to about 70° C. The UV imaging temperature can be about 65° C. Other UV, IR or similar imaging temperatures can be set according to a type of erasable media and such imaging temperatures are intended to be included within the scope of the invention.

In embodiments, the write subsystem 260 can include a heat source. The heat source can heat the erasable medium to a temperature suitable for imaging, for example, UV imaging. The heat source will be further described in connection with FIG. 3, below.

A front face of each of the conventional imaging device 240 and write subsystem 260 are substantially parallel to the medium being imaged. The imaging device 240 and write subsystem 260, which travel orthogonally to the direction that the medium travels, deposit ink droplets or radiantly images the medium in an image wise fashion. The image deposited or otherwise formed on the medium includes text and/or graphic images, the creation of which is controlled by controllers 290 and 295, in response to electrical signals transmitted through a cable 246 coupled to the imaging device 240. A star wheel 248 or other known drive mechanism picks up the lead edge of an imaged medium and pulls the medium into the output 230.

In certain embodiments, a user interface 280 can be provided in the housing 210. The user interface 280 can include control components, responsive to user input, for directing the functions of the dual mode imaging system 200. In certain embodiments, the dual mode imaging system 200 can be configured through the user interface 280 to start up in an erasable media imaging mode or conventional printing (of non-erasable media) mode.

In certain embodiments, an administrator interface 295 can be provided via network connection to the housing 210. The administrator interface 295 can include control options directing the functions of the dual mode imaging system. In certain embodiments, the dual mode imaging system 200 can be configured through the administrator interface 295 to start up in an erasable media imaging mode or regular (non-erasable media) printing mode.

Job selection can be executed at the user interface 280. Alternatively, job selection can be executed at the administrator interface 295. In a third alternative, job selection can be executed at the user's personal computer print dialog box through the properties link to the print driver controls. Alternatively, the user interface 280 can prompt the operator to check for the proper media at the job start. The user interface 280 can further be responsive to the sensor 225 and the sensor 225 can be responsive to input at the user interface 280.

Figure 3A:
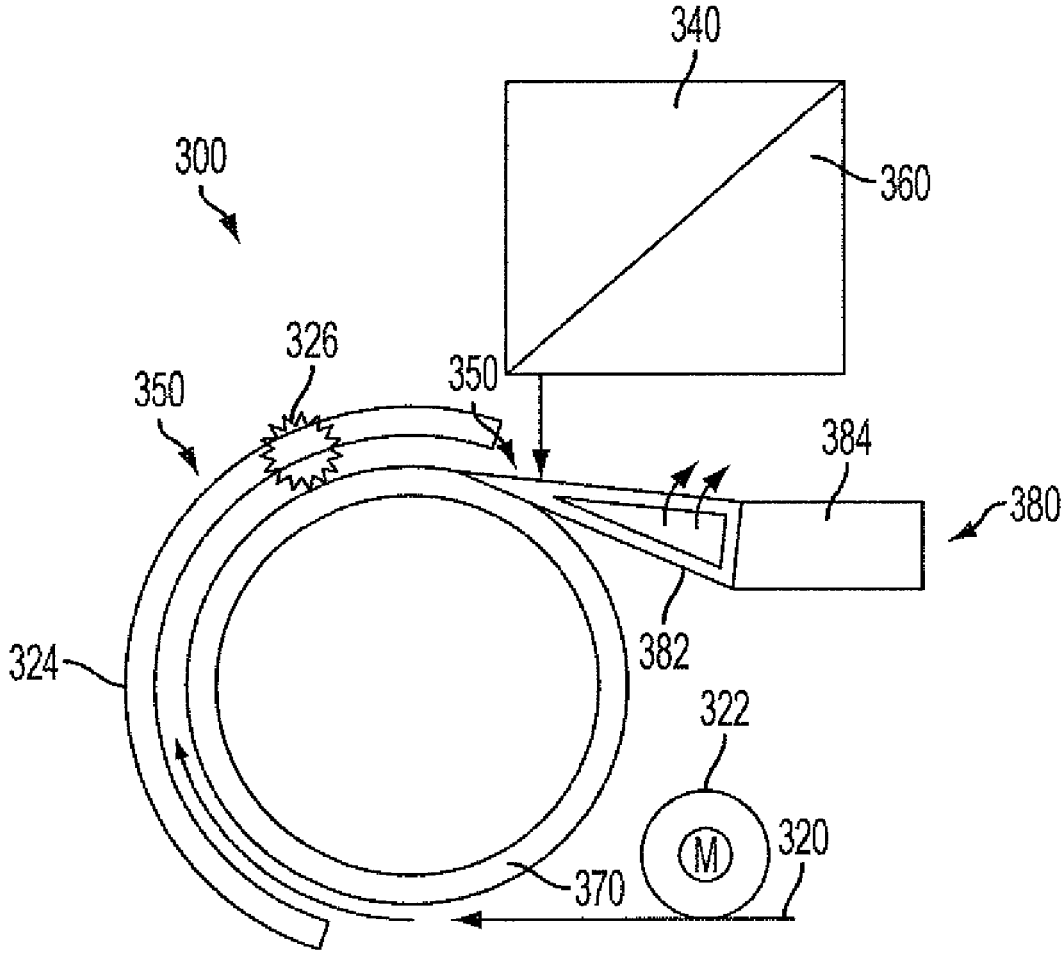
FIG. 3A is a side view depicting heating and cooling architecture of the dual mode imaging device of FIG. 2 in accordance with the present teachings.
Figure 3B:
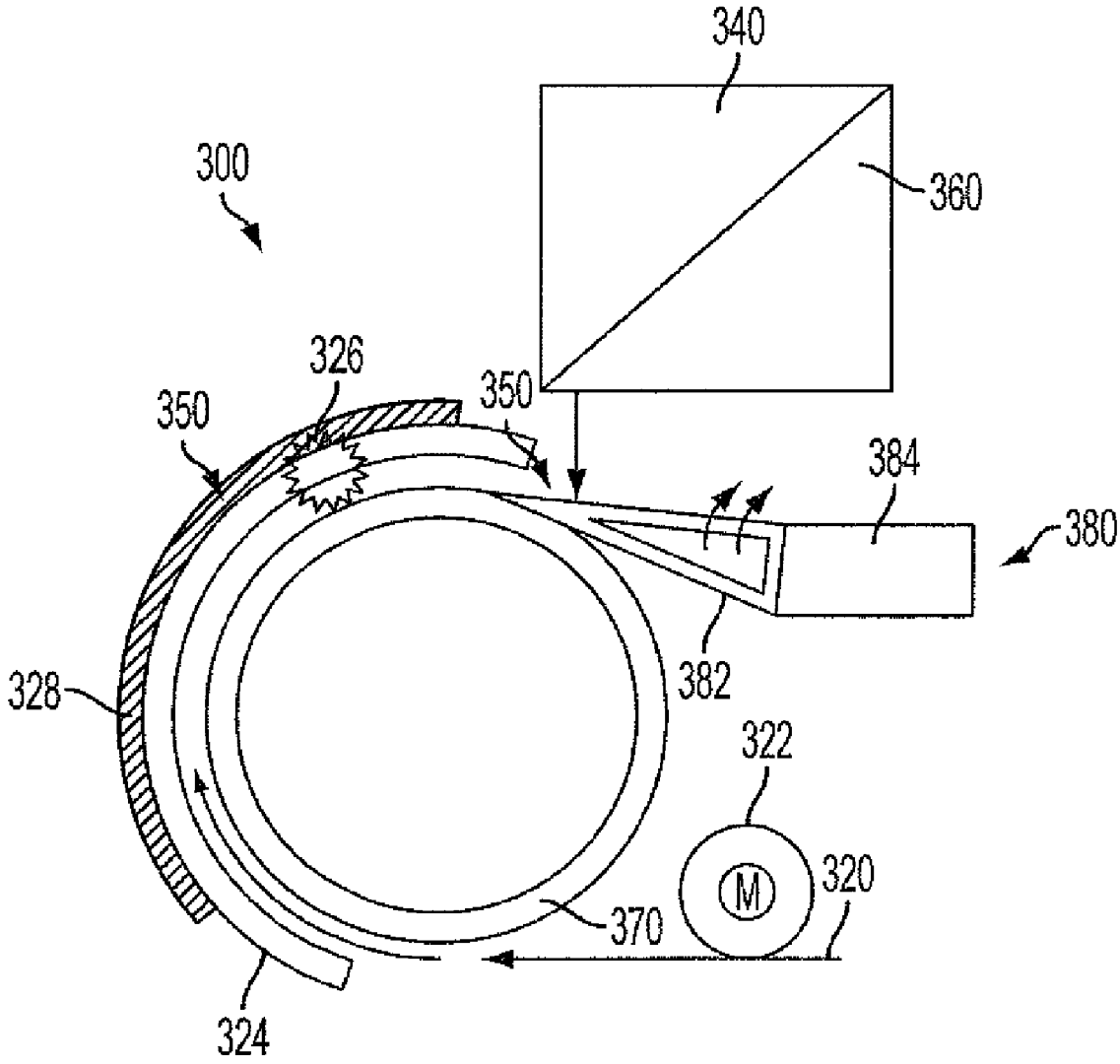
FIG. 3B is a side view detailing additional heating and cooling architecture of the dual mode imaging device of FIG. 2 in accordance with the present teachings.

FIGS. 3A and 3B depict exemplary internal architecture 300 in accordance with the present teachings. The internal architecture 300 can be provided to selectively heat, cool, and image one of erasable media and non-erasable media within the dual mode imaging device 200. Effective erasable media imaging and erase requires the erasable media to be heated to a specified temperature during the writing process. The erase step requires the erasable media to be heated to an even higher temperature. In small office devices, it can be extremely important to have a simple and effective design in order to minimize the base product cost and energy usage.

The internal architecture 300 can provide localized heating of an erasable media as part of a write operation. It should be readily apparent to one of ordinary skill in the art that the internal architecture 300 depicted in FIGS. 3A and 3B represents generalized schematic illustrations and that other components can be added or existing components can be removed or modified.

Current versions of erasable media, particularly that utilizing UV writing on erasable photochromic media, require heating the erasable medium. Heating can be to a temperature between about 55° C. to about 80° C. Heating can further be to a temperature between about 60° C. to about 70° C. For example, heating can be to a temperature of about 65° C. Exemplary architecture herein can maintain the erasable media at a desired temperature without wasting energy.

As shown in FIGS. 3A and 3B, the internal architecture 300 can include a media feed 320, a media drive wheel 370, a media guide baffle 324, a temperature management subsystem 350, and a media support guide 380. The media guide baffle 324 can further include a heat source 326 incorporated therein. The media support guide 380 can also include each of a heating device 382 and a cooling device 384 incorporated therein or adjacent thereto. Imaging devices 340/360 can be positioned at a discharge of a transported medium from the drive wheel 370. The imaging device 340 can include an erasable media imaging system and the imaging device 360 can include a conventional imaging system. Conventional imaging systems can include ink jet imaging systems. Ink jet imaging systems can include aqueous ink jet, solid ink jet, and gel ink jet.

In general, erasable and non-erasable media can be supplied to the temperature management subsystem 350 at the media feed 320 and transported by the media drive wheel 370 to the media support guide 380. The guide baffle 324 can be positioned to oppose a surface of the media not in contact with the drive wheel 370. It will be appreciated that use of the term media herein can include at least one of erasable media (including an erased or original erasable media) and non-erasable paper.

In embodiments, the media feed 320 can include any known media feed or input suitable for supplying media to dual mode imaging device 200. By way of example, the media feed 320 can include one or more input trays. The media feed 320 can include take-up rollers 322 in connection with the input tray. Multiple media feeds 320 can be utilized according to a type of media input into the dual mode imaging device 200.

In embodiments, the drive wheel 370 can include one or more wheels for transporting the media from the feed 320 to the support guide 380. The drive wheel 370 can be activated and rotated by internal mechanisms and powered by a motor "M" as known in the art. The drive wheel 370 can transport media in a predetermined path from feed to imaging, and ultimately to an output. The output can be internal to the dual mode imaging device 200, and the output can external to the dual mode imaging device 200.

In embodiments, the guide baffle 324 can substantially correspond in shape to an outer peripheral surface of the drive wheel 370. For example, the guide baffle 324 can be arcuate in shape. The guide baffle 324 can be of a length to span a predetermined surface of the drive wheel 370. In certain embodiments, the guide baffle 324 can be of a length to encompass a full length of a media transported by the drive wheel 370. However, other lengths of the guide baffle 324 are considered as being within the scope of this disclosure. It will be appreciated that while the guide baffle 324 is depicted as arcuate, any suitable configuration can be envisioned, according to an end imaging device. For example, the guide baffle 324 can be substantially flat to correspond to belt feeding of media as known in the art.

As depicted, a heat source 326 can be provided in connection with the guide baffle 324. In certain embodiments, the heat source 326 can include heater elements formed within the guide baffle 324. For example, the heater elements of the heat source 324 can include resistive heating elements. The heat source 326 can include one or more layers of heat imparting material formed on one or more of an inner surface and an outer surface of the guide baffle 324 (FIG. 3B). Although the heat source 326 is depicted as being formed on the inner surface of the guide baffle 324, it will be appreciated that the heat source 326 can be formed on an outer surface of the guide baffle 324 without intending to limit the scope of the invention.

The heat source 326, as formed on an inner or outer surface of the baffle 324, can include heat tape, such as a resistive heat tape, or a heat pad such as that manufactured by OEM Heaters. It will be appreciated that the heat source 326 can cover part or an entirety of the guide baffle 324, whether internally, on the inner surface, or on the outer surface thereof. In embodiments, the heat source 324 can be localized to provide localized heating of the substrate as part of a write operation on erasable media as will be described further.

The guide baffle 324 can be spaced apart from the drive wheel 370 by a predetermined and constant spacing. The guide baffle 324 can be spaced a distance to accommodate the heat source 326 provided thereon, and thereby space the heat source 326 from media transported on the drive wheel 370. As such, the heat source 326 can be positioned to heat the erasable media without damaging the media. It will be appreciated that the guide baffle 324 and hence heat source 326 can be positioned to effect any desired proximity to the drive wheel 370 without contacting the media being transported by the drive wheel 370. The heat source 326 can be of a dimension to heat all or a portion of the erasable media transported by the drive wheel 370. The heat source 326 can be of an intensity to heat the erasable media throughout a thickness of the erasable media. The heat source 326 can further be of an intensity to heat only that surface of the erasable media exposed to the heat source 326.

In embodiments, and shown by way of example in FIG. 3B, an insulative material 328 can be provided on an external surface of the guide baffle 324. The insulative material 328 can be formed to overlay or encompass any heat source formed on the external surface of the guide baffle 324. Insulation can minimize heat loss and improve temperature control in connection with the heat source 326 and guide baffle 324. The insulative material 328 can include one or more layers of air, low thermal conductivity foam, polystyrene foam, and the like.

In embodiments, the support guide 380 can be positioned at a dispatch point (region) where the erasable medium is released from the drive wheel 370. The support guide 388 can be of a length to accommodate a part or an entirety of the erasable medium released from the drive wheel 370 according to a configuration of the dual mode imaging device 200. In general, the support guide 380 can maintain the erasable medium flat during imaging of or writing on the medium, typically by providing a substantially flat support surface. The support guide 380 can further include a support guide heat source 382 incorporated therein. The support guide heat source 382 can include at least one of an internal and external heat source. The internal heat source can include resistive or similar internal heater, powered by the dual mode imaging device or otherwise. The external heat source can include, for example, a heat pad positioned on a surface of the support guide 380 facing imaging systems 340 and 360. The support guide heat source 382 can maintain a correct temperature of an erasable medium during exposure by the translating erasable media write system 340.

The support guide 380 can also include a cooling device 384 incorporated therein or adjacent thereto. In embodiments, the cooling device 384 can be positioned internal to the support guide 380. Likewise, the cooling device 384 can be positioned external to the support guide 380. The cooling device 384 can be positioned proximate a trailing end (as determined by a media transport) of the support guide 380, including above, below, or above and below the trailing end of the support guide 380. As such, cooling air can lower a temperature of an imaged erasable medium immediately subsequent to imaging by the erasable media write system 340, thereby maintaining a maximum possible optical density of an imaged erasable medium. In embodiments, the cooling air can limit the temperature of possible touch points on imaged erasable medium.

The cooling device 384 can include active cooling of erasable media. In an active cooling, the cooling device 384 can direct a flow of cooling medium, such as cold air, onto an imaged erasable media. Active cooling can take place for a period of time and temperature suitable to reduce a temperature of the imaged erasable media to an ambient or other temperature. Ambient temperature can include a temperature below an imaging temperature. For example, ambient temperature can include room temperature. Further, active cooling can take place for a period of time and at a temperature suitable to reduce the temperature of the imaged erasable media to a UV imaging temperature. In certain embodiments, the cooling device 384 can include a fan. In certain embodiments, the cooling device 384 can include cold plates, rollers, condensers, and similar cooling apparatus acting on or adjacent to the imaged erasable media.

The described heating and cooling architecture can also minimize heat generated internally of the dual mode imaging device 200, and allow for a conventional ink jet printing system to be incorporated into the dual mode imaging device 200. Specifically, the conventional ink jet printing system 360 can be incorporated into the same housing as the erasable media write system 340.

It will be appreciated that the temperature management subsystem 350 can be utilized to generate heat which can dry an ink deposited on a surface of a conventional non-erasable medium. More specifically, support guide heat source 382 can generate an amount of heat sufficient to dry a conventional ink. Even further, it will be appreciated that the support guide cooling device 384 can be utilized to cool a heated non-erasable medium.

Figure 4:
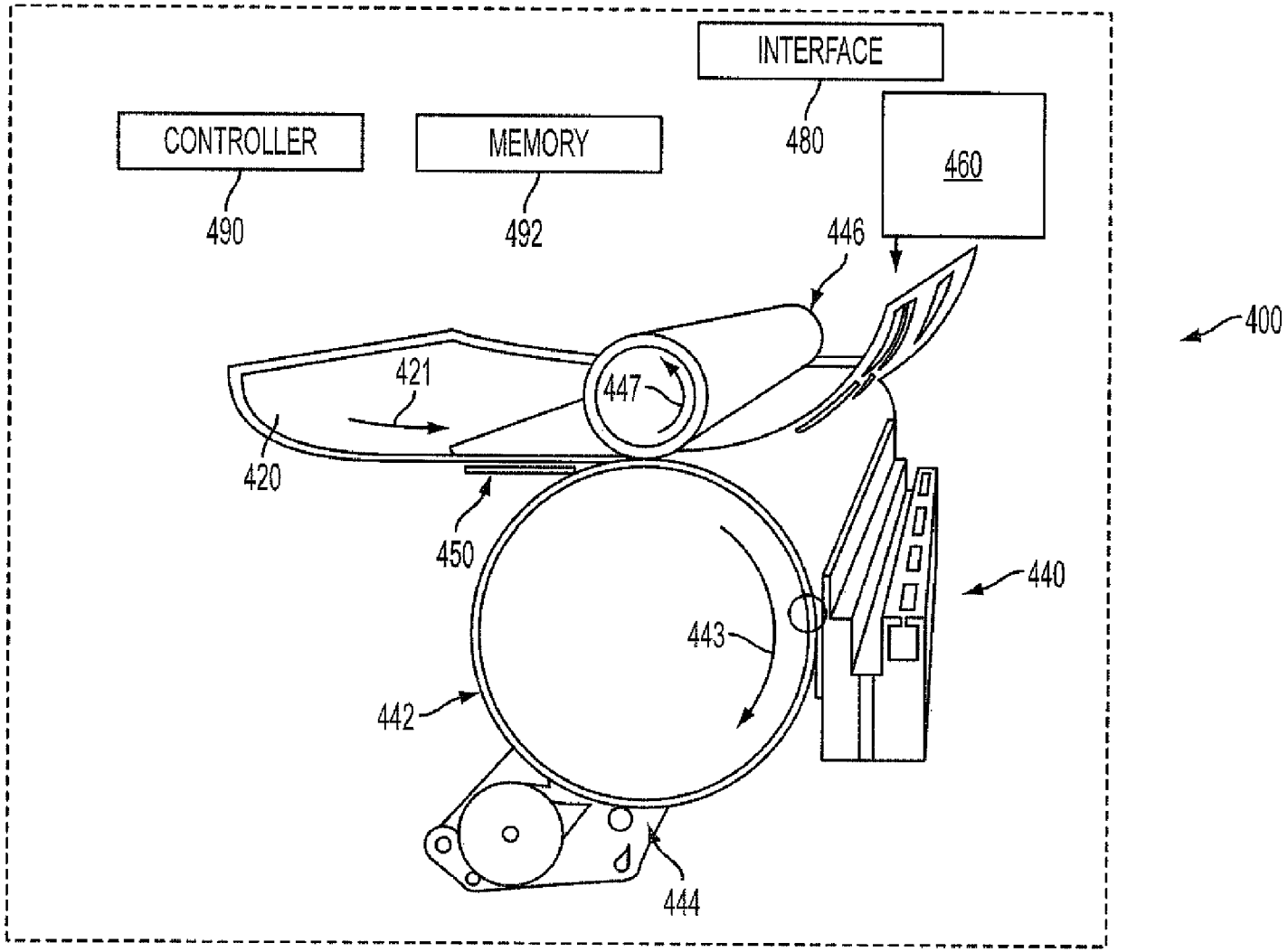
FIG. 4 is a perspective view depicting another dual mode imaging device in accordance with the present teachings.

FIG. 4 depicts an exemplary dual mode imaging system 400 incorporating each of a solid ink printer and an erasable media write system in accordance with the present teachings. It should be readily apparent to one of ordinary skill in the art that the dual mode imaging system 400 depicted in FIG. 4 represents a generalized schematic illustration and that other components can be added or existing components can be removed or modified.

As shown in FIG. 4, an internal configuration of an alternative dual mode imaging system 400 can include conventional imaging components and an erasable media write device 460. The conventional imaging components can include solid ink imaging components such as a full width solid ink print head 440, an intermediate transfer drum 442, a drum cleaner 444, a pressure roller 446, a controller 490 and a memory 492. A heater 450 can be provided in advance of the pressure roller 446 and operable as a media transport device in connection with each of the conventional imaging components and the erasable media write device 460 as will be further described. One of an erasable media and a non-erasable media 420 can pass through the configuration, including the media transport device, in the direction of arrow 421 as shown.

The memory 492 can include, for example, any appropriate combination of alterable, volatile or non-volatile memory, or non-alterable or fixed memory. The alterable memory, whether volatile or non-volatile, can be implemented using any one or more of static or dynamic RAM, a floppy disk and disk drive, a writeable or re-writeable optical disk and disk drive, a hard drive, flash memory or the like. Similarly, the non-alterable or fixed memory can be implemented using any one or more of ROM, PROM, EPROM, EEPROM, an optical ROM, such as CD-ROM or DVD-ROM disk, and disk drive or the like. It should also be appreciated that the controller 490 and/or memory 492 may be a combination of a number of component controllers or memories all or part of which may be located outside the printer 400.

When configured to print an ink image on the intermediate transfer drum 442, the one or more print heads within the full width print head 440, under control of the controller 490, is positioned in close proximity to the intermediate transfer drum 442. As a result, under control of the controller 490, the full width print head 440 ejects ink droplets onto the intermediate transfer drum to form ink images thereon. While ink droplets are being deposited on the intermediate transfer drum 442, the pressure roller 446 is not in contact with the intermediate transfer drum 442.

Once an image or images have been printed on the intermediate transfer drum 442, according to either of a known single pass method or multi-pass method and under control of the controller 490, the solid ink jet printer 400 converts to a configuration for transferring and fixing the image or images from the intermediate transfer drum 442 onto the non-erasable medium 420. According to this configuration, non-erasable medium 420 is transported to a position between the movable or positionable transfixing roller 446 and intermediate transfer drum 442, as indicated by arrow 421. The transfixing roller 446 applies pressure against the back side of the non-erasable medium 420 in order to press the front side of the non-erasable medium against the intermediate transfer drum 442. The transfixing roller 446 can be heated to aid in transfixing the image to the non-erasable medium.

In addition, heater 450 can be positioned along the feed path in advance of the transfixing roller 446. The heater 450 can be, for example, configured as a plate. The heater plate can include resistors formed therein, heat tape formed on one or more surfaces of the heater. The heater 450 can generate a temperature suitable for heating either an erasable medium or non-erasable medium passing thereover, as required by a function of the dual mode imaging device 400. For example, the heater plate 450 can preheat a non-erasable medium 420 to aid in transfixing the image thereto. The pressure created by the transfixing roll 446 on the back side of the heated non-erasable medium 420 facilitates the transfixing (transfer and fusing) of the image from the intermediate transfer drum 442 onto the non-erasable medium 420.

Further, the heater 450 can preheat an erasable medium 420 to a temperature suitable for imaging by the erasable media write device 460.

In certain embodiments, the erasable media write device 460 can include imaging components suitable for imaging erasable media. For example, the erasable media write device 460 can UV image an erasable media once the erasable media reaches a predetermined temperature. An exemplary UV imaging temperature of an erasable media can be from about 50° C. to about 80° C. A UV imaging temperature can further be from about 60° C. to about 70° C. The UV imaging temperature can be about 65° C. Other UV, IR or similar imaging temperatures can be set according to a type of erasable media and such imaging temperatures are intended to be included within the scope of the invention.

In embodiments, the erasable media write device 460 can include the heater 450 as the heat source. The heater 450 can heat the erasable medium to a temperature suitable for imaging, for example, UV imaging.

The rotation or rolling of both the intermediate transfer drum 442 and transfixing roll 446, as shown by arrows 442, 447, respectively, not only transfix the images onto the non-erasable medium 420, but also assist in transporting the medium between them.

Once an image is transferred from the intermediate transfer drum 442 and transfixed to a medium 420, the transfixing roll 446 is moved away from the intermediate transfer drum 442 and the intermediate transfer drum 442 continues to rotate and, under the control of the controller 490, any residual ink left on the intermediate transfer drum 442 is removed by well known drum maintenance procedures at a maintenance station, such as drum cleaner 444.

The image deposited or otherwise formed on the medium can include text and/or graphic images, the creation of which is controlled by controller 490. A user interface 480 can be included in the imaging device. The user interface 480 can include control components, responsive to user input, for directing the functions of the dual mode imaging system 400. In certain embodiments, the dual mode imaging system 400 can be configured through the user interface 480 to start up in an erasable media imaging mode or conventional printing (of non-erasable media) mode.

Job selection can be executed at the user interface 480. Alternatively, job selection can be executed at the user's personal computer print dialog box through the properties link to the print driver controls. Alternatively, the user interface 480 can prompt the operator to check for the proper media at the job start.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g. −1, −1.2, −1.89, −2, −2.5, −3, −10, −20, −30, etc.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A dual mode imaging system comprising:
an ink jet device for imaging non-erasable media;
a write device for imaging erasable media;
a media transport subsystem for supplying non-erasable and erasable media to one of the ink jet device and the write device, wherein the media transport subsystem comprises:
a media advance guide baffle opposing and spaced from a media drive wheel by a constant spacing, wherein the media transport subsystem is configured to maintain the constant spacing during transport of the non-erasable media, the erasable media, and an imaged erasable media through the media transport subsystem;
a feed roller configured to transport the non-erasable and erasable media to the media advance guide baffle; and
a drive mechanism configured to transport the non-erasable and erasable media to an output; and
a heat source incorporated into the media advance guide baffle of the media transport subsystem, the heat source heating erasable media to a temperature suitable for imaging at the write device.

2. The system of claim 1, wherein the heat source is positioned on an outer surface of the media advance guide baffle of the media transport subsystem.

3. The system of claim 1, wherein the heat source is positioned on an inner surface of the media advance guide baffle of the media transport subsystem.

4. The system of claim 1, wherein the heat source is integrally formed with the media transport subsystem.

5. The system of claim 1, wherein the heat source comprises resistive heating.

6. The system of claim 1, wherein the heat source is connected to the guide baffle such that an erase temperature of an erasable medium is established by the heat source.

7. The system of claim 6, wherein the heat source is positioned on an outer surface of the guide baffle.

8. The system of claim 6, wherein the heat source is positioned on an inner surface of the guide baffle.

9. The system of claim 6, wherein the heat source is integrally formed with the guide baffle.

10. The system of claim 6, wherein the heat source comprises resistive heating.

11. The system of claim 1, further comprising a support guide for supporting non-erasable media during imaging at the ink jet device and supporting erasable media during imaging at the write device.

12. The system of claim 11, the support guide further comprising a support guide heater for heating erasable media during imaging.

13. The system of claim 11, the support guide further comprising a cooling device for cooling an imaged medium.

14. The system of claim 13, the cooling device positioned downstream of the support guide heater.

15. The system of claim 11, the support guide heater comprising resistive material.

16. The system of claim 13, the cooling device comprising an active cooling device.

17. A dual mode imaging device comprising:
an ink jet device for imaging non-erasable media;
a write device for imaging erasable media;
a media transport subsystem for supplying non-erasable and erasable media to one of the ink jet device and the write device, wherein the media transport subsystem comprises:
a media advance guide baffle opposing and spaced from a media drive wheel by a constant spacing, wherein the media transport subsystem is configured to maintain the constant spacing during transport of the non-erasable media, the erasable media, and an imaged erasable media through the media transport subsystem;
a feed roller configured to transport the non-erasable and erasable media to the advance guide baffle; and
a star wheel configured to pick up a leading edge of an imaged medium and pull the imaged medium into an output; and
a heat source incorporated into the media advance guide baffle of the ink jet device, an imaging temperature of an erasable medium established by the heat source.

18. The device of claim 17, wherein the heat source is positioned on an outer surface of the guide baffle.

19. The device of claim 17, wherein the heat source is positioned on an inner surface of the guide baffle.

20. The device of claim 17, wherein the heat source is integrally formed with the guide baffle.

21. The device of claim 17, wherein the erasable media comprises photochromic paper.

22. The device of claim 17, wherein the erasable media imaging temperature is in a range of about 55° C. to about 80° C.

23. The device of claim 17, wherein the erasable media imaging temperature is in a range of about 60° C. to about 70° C.

24. The device of claim 17, wherein the write device comprises UV imaging.

25. The device of claim 17, wherein the ink jet device comprises one of an aqueous ink, gel ink, and solid ink imaging system.

26. A method of dual mode imaging comprising:
incorporating a heat source with a paper advance guide baffle of an ink jet imaging device, the guide baffle forming a common media path for each of erasable media and non-erasable media, wherein the guide baffle is spaced from a media drive wheel by a constant spacing to provide a portion of the common media path in the space between the guide baffle and the media drive wheel;

transporting unimaged erasable media, unimaged non-erasable media, and imaged erasable media to the space between the guide baffle and the media drive wheel using a take-up roller;

erasing the imaged erasable media;

establishing, via the heat source, an imaging temperature of an erasable medium;

selectively imaging erasable media at the imaging temperature with a write device to form an imaged erasable media;

selectively imaging non-erasable media with the ink jet device to form an imaged non-erasable media;

transporting the imaged erasable media and the imaged non-erasable media from the space between the guide baffle and the media drive wheel using a drive mechanism;

cooling the imaged erasable media; and maintaining the constant spacing between the guide baffle and the media drive wheel during the transport of the erasable media, the non-erasable media, and the imaged erasable media from the space between the guide baffle and the media drive wheel.

27. The method of claim 26, wherein the erasable paper comprises photochromic paper and the write device comprises UV imaging.

28. The method of claim 26, wherein the ink jet device comprises one of an aqueous ink jet device, a solid ink jet device or a gel ink jet device.

* * * * *